US008910749B1

(12) United States Patent
Jensen

(10) Patent No.: US 8,910,749 B1
(45) Date of Patent: Dec. 16, 2014

(54) SKID-MOUNTED SCISSOR LIFT PLATFORM

(71) Applicant: Dallas S. Jensen, Dodge Center, MN (US)

(72) Inventor: Dallas S. Jensen, Dodge Center, MN (US)

( * ) Notice: Subject to any disclaimer, the term of this patent is extended or adjusted under 35 U.S.C. 154(b) by 0 days.

(21) Appl. No.: 13/966,751

(22) Filed: Aug. 14, 2013

Related U.S. Application Data

(60) Provisional application No. 61/682,829, filed on Aug. 14, 2012.

(51) Int. Cl.
*B66F 11/00* (2006.01)
*B66F 11/04* (2006.01)

(52) U.S. Cl.
CPC ..... *B66F 11/042* (2013.01)
USPC ..... 182/69.5

(58) Field of Classification Search
CPC ..... B66F 11/042
USPC ..... 182/69.5
See application file for complete search history.

(56) References Cited

U.S. PATENT DOCUMENTS

| | | | | | |
|---|---|---|---|---|---|
| 6,155 | A | * | 3/1849 | Huttman et al. | 182/69.1 |
| 801,614 | A | * | 10/1905 | Sebastian | 182/69.5 |
| 2,086,255 | A | * | 7/1937 | Cashier et al. | 182/69.5 |
| 2,937,003 | A | * | 5/1960 | Croll | 254/93 R |
| 3,341,042 | A | * | 9/1967 | Carder | 414/471 |
| 3,606,255 | A | | 9/1971 | Stevens | |
| 4,216,933 | A | * | 8/1980 | Cramer, Jr. | 248/188.5 |
| 4,573,663 | A | | 3/1986 | Nussbaum | |
| 4,741,512 | A | | 5/1988 | Elkuch et al. | |
| D302,893 | S | | 8/1989 | Wakefield | |
| 5,082,085 | A | | 1/1992 | Ream et al. | |
| 5,211,259 | A | | 5/1993 | Kishi | |
| 5,403,144 | A | * | 4/1995 | Staben, Jr. | 414/697 |
| 5,555,953 | A | * | 9/1996 | Henderson | 182/141 |
| 5,588,500 | A | * | 12/1996 | Yonahara | 182/141 |
| 6,883,641 | B2 | * | 4/2005 | Julien | 182/69.1 |
| 7,339,134 | B2 | * | 3/2008 | Stropki et al. | 219/130.1 |

* cited by examiner

*Primary Examiner* — Alvin Chin-Shue
(74) *Attorney, Agent, or Firm* — Robert C. Montgomery; Montgomery Patent & Design

(57) ABSTRACT

A scissor lift platform adapted to attach to an existing skid steer loader provides the functionally of a scissor lift to elevate personnel and equipment. The platform comprises hand rails and a lift control panel supported by a hydraulic scissor lift assembly section. The base of the scissor lift assembly is provided with a box-like frame attachable to a front loader portion of the skid steer loader and equipped with a hydraulic pivoting mechanism to keep the platform level.

13 Claims, 6 Drawing Sheets

SKID-MOUNTED SCISSOR LIFT PLATFORM

RELATED APPLICATIONS

The present invention was first described in and claims the benefit of U.S. Provisional Application No. 61/682,829, filed Aug. 14, 2012, the entire disclosures of which are incorporated herein by reference.

FIELD OF THE INVENTION

The present invention relates to a scissor lift assembly having a man platform attached to a tilting assembly configured to be attached to and manipulated by a skid steer assembly.

BACKGROUND OF THE INVENTION

Scissors lifts, or hydraulically-operated scaffolding, are extremely useful in the construction and maintenance industry fields. They provide a stable elevated work surface that is easy to erect, and most importantly, safe. Unfortunately, such scissors lifts are extremely expensive to own, especially if they are only used occasionally for short periods of time. Renting is not always an option, especially if at a remote location where transportation of the lift is a problem. Furthermore, whether purchased or rented, a scissor lift occupies a large amount of storage space when not being used. While the actual scissors portion of the lift is generally simple, straight forward, and low cost, it is the base of the unit, with its heavy mass, power units, hydraulic pumps, and transportation system, where most of the cost is experienced. Accordingly, there exists a need for a means by which the functionality of a scissors lift can be utilized without the disadvantages as described above.

Prior art in this field consists of simple scissor jacks, load leveling devices, or complex portable scissor lifts. Simple scissor jacks incorporate the scissor framework, but lack the necessary hydraulic power and transmission means to hoist heavier loads and hoist to heights achieved by the present invention. Load leveling devices are portable, but are not transportable by devices such as skid loaders. Furthermore, load leveling devices cannot be connected with skid loaders to enable command and control of the load leveler via the skid loader. Both styles of devices lack the means to tilt and oscillate the work platform in such a manner afforded by the present invention. Portable scissor lifts are complex, elaborate machines that are relatively expensive. Such machines lack the utility of being connected to a skid loader and lack the ability of availing the hydraulic power of the skid loader to perform hoisting and tilting functions. It is an object of this invention to provide a scissor lift working platform that avails the hydraulic power of an ancillary vehicle so as to reduce cost and space of the scissor lift hoisting machine. It is a further object of this invention to provide a means to tilt and oscillate the working platform from a control panel of the platform or from the controls of the ancillary vehicle. A beneficial feature of this invention is to provide stabilizers to ensure a level and secure base from which the platform is hoisted.

SUMMARY OF THE INVENTION

The apparatus comprises a platform positioned on top of a scissor-style hydraulic lifting mechanism. A top surface of the platform is provided with a railing and a control panel. The apparatus is further equipped with a tilt assembly to enable oscillatory motion of the platform and hydraulic lifting mechanisms in order to compensate for uneven ground surfaces, thereby providing a level working surface from which a user stands upon. The tilt assembly attaches to a skid frame of a skid loader, and the hydraulic components of the hydraulic lift and tilt assembly are placed into hydraulic communication with the hydraulic system of the skid loader to facilitate operational control of the lift and tilt through the controls of the skid loader. In addition, the normal actuating, tilting, and oscillation motions of the skid loader further enable a user to maneuver the platform to a desired position and location. The skid loader provides limited lifting and tilting, but a wide range of transportability and maneuverability of the work platform. The control panel provides a wide range of lifting and tilting, but limited transportability and maneuverability of the work platform. Therefore, the skid loader controls, in conjunction with the control panel of the platform, are used to maneuver, lift, tilt, and oscillate the platform to a desired location and position. Additionally, four (4) height-adjustable feet are disposed on the apparatus to serve as stabilizers.

The base of the scissor section is provided with a standard universal loading plate, which attaches to almost all types of skid loaders, and is equipped with a pivot joint to keep the platform level at all times. After attaching the platform and tilt assembly to a front portion of a skid loader, the necessary hydraulic hoses are connected to place the platform and tilt assembly in hydraulic communication with the hydraulics of the skid loader. The platform can then be transported by the skid loader to a desired location to perform work. These particular features of the invention allow the platform to lifted a few feet using only the arm of the skid loader, but lifted further using the supplied scissor lift assembly. Many of the expensive components of a conventional scissor lift, such as the power unit, hydraulic pump, transportation system, and the like, are shared with the skid loader making the invention much more feasible, cost effective, and easy to store. The use of the present invention provides for the complete functionality of a scissor lift with reduced costs, floor space usage, and increased simplicity.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
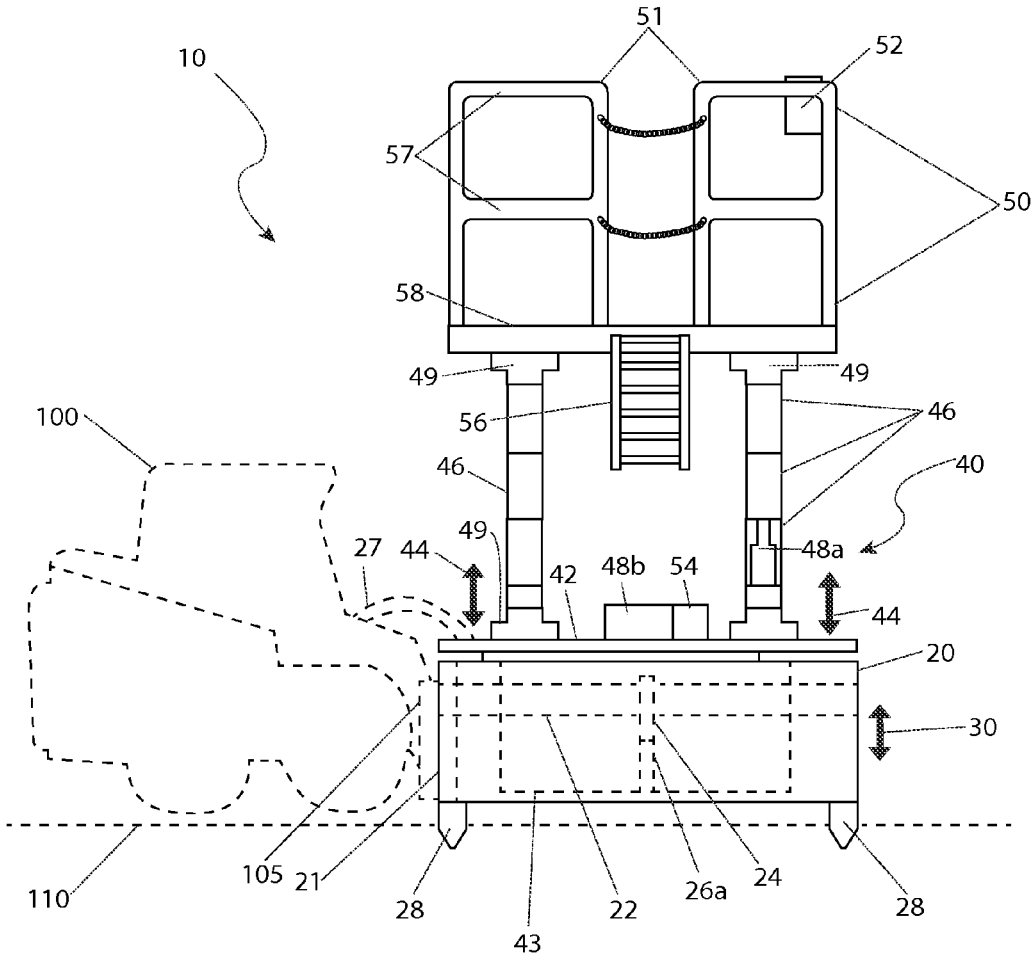
FIG. 1 is a side view of a skid-mounted scissor lift platform 10, according to a preferred embodiment of the present invention.

10 skid-mounted scissor lift platform
20 skid frame
21 skid steer plate
22 torsion bar
24 ear plate
26*a* first tilt cylinder
26*b* second tilt cylinder
26*c* clevis
27 loader hydraulic hose
28 safety foot
29*a* fastener
29*b* fastener aperture
30 front-to-rear tilt arrow
32 hydraulic connector
40 tilt assembly
42 upper plate
43 lower plate
44 side-to-side tilt arrow
46 scissor lift assembly
47 pivot pin
48*a* lift cylinder
48*b* hydraulic reservoir/pump unit
48*c* hydraulic line
49 mounting bracket
50 man platform
51 gate
52 lift control panel
53 lift switch
54 battery/battery box
55 battery charging connector
56 ladder
57 hand rail
58 platform floor
100 skid steer loader
105 implement attachment means
110 ground surface

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a skid-mounted scissor lift platform (herein described as the "apparatus") 10, which provides a hydraulically-operated attachment for an existing skid steer loader 100 being capable of elevating a man platform 50 via integration of a scissor lift assembly 46. The apparatus 10 provides side-to-side tilting of the scissor lift assembly 46 and the man platform 50. When combined with a front-to-rear tilting capability of the existing skid steer loader 100, the apparatus 10 provides a means to correct for an uneven ground surface 110 and to position the man platform 50 in a level manner for safe vertical elevation of personnel and equipment.

Referring now to FIGS. 1, 2, 3, and 4, side and front views of the apparatus 10, according to the preferred embodiment of the present invention, are disclosed. The apparatus 10 comprises a skid frame 20, a tilt assembly 40, a scissor lift assembly 46, and a man platform 50.

The apparatus 10 comprises a box-like skid frame portion 20 which rests upon a ground surface 100 via height-adjustable safety feet 28, thereby acting as a stable foundation portion of the apparatus 10. The skid frame 20 further comprises an integral vertical skid steer plate 21 along one (1) side which allows secure interlocking attachment to an implement attachment means 105 of the skid steer loader 100. Said skid steer plate 21 and implement attachment means 105 are envisioned to be commercially-available equipment commonly sold by manufacturers of skid steer loaders 100.

The apparatus 10 works in conjunction with a standard skid steer loader 100 similar those manufactured by GEHL®, JOHN DEERE®, and others, preferably providing a universal plate-type implement attachment means 105; however, other equivalent attachment means my be provided which provide attachment and front-to-rear tilting of the apparatus 10.

Figure 3:
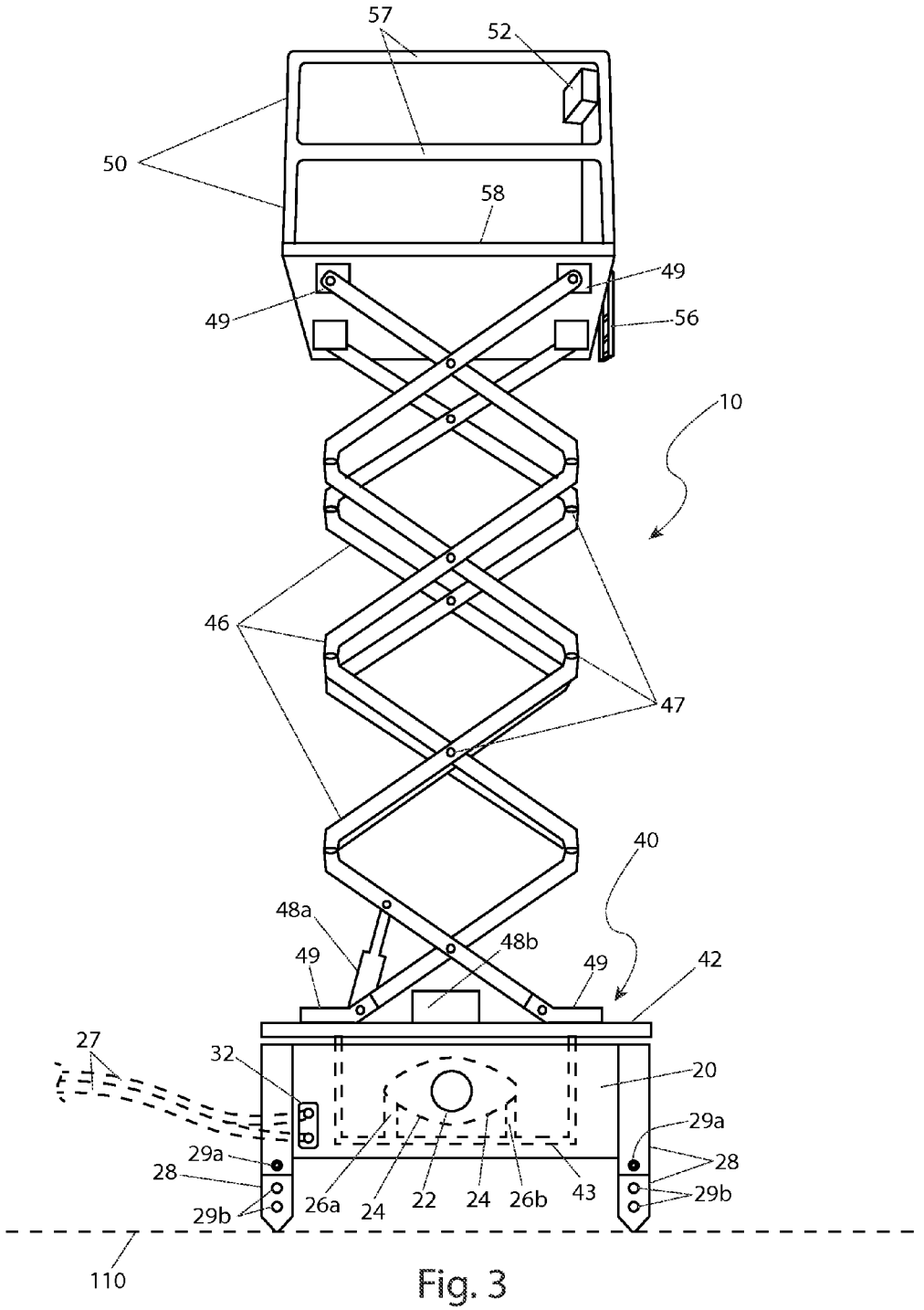
FIG. 3 is a front view of the skid-mounted scissor lift platform 10, according to a preferred embodiment of the present invention.
Figure 4:
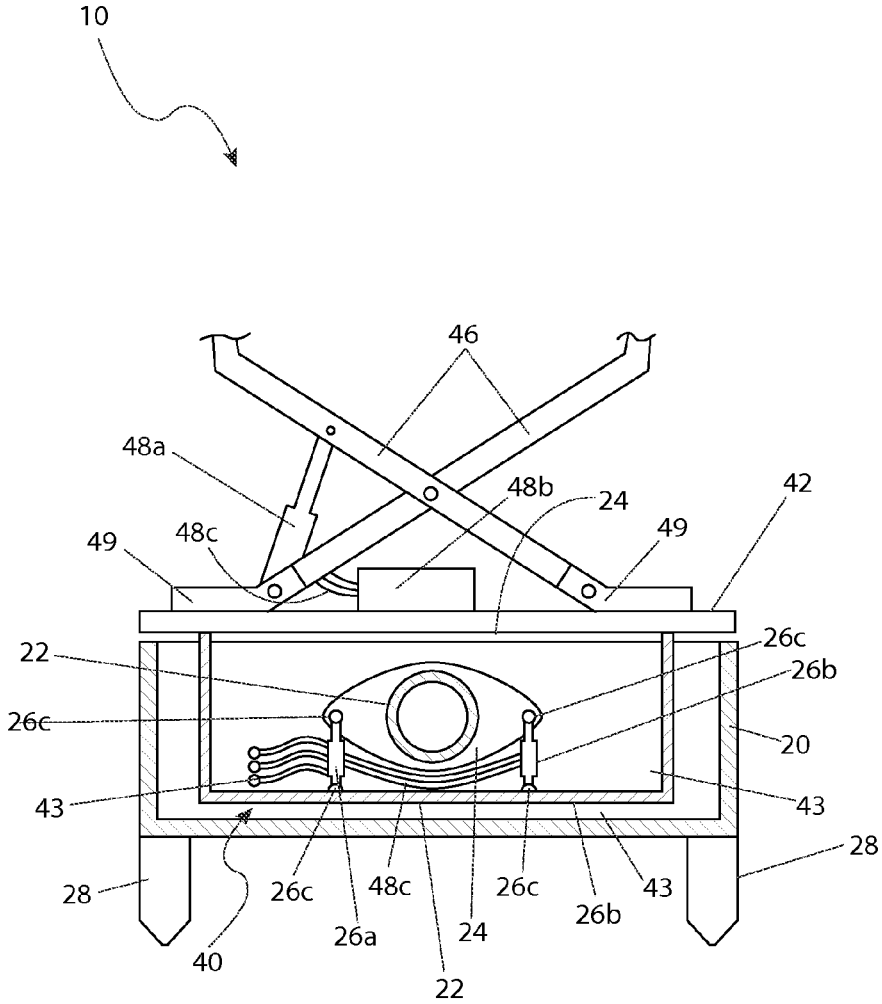
FIG. 4 is a front cut-out view of the skid-mounted scissor lift platform 10, according to a preferred embodiment of the present invention.

The box-like skid frame portion 20 provides containment of, and rotating attachment to a tilt assembly 40 comprising a box-shaped welded structure which provides side-to-side tilting capability to the superjacent scissor lift assembly 46 and attached man platform 50 portions. Said tilting function is enabled by internal portions including an ear plate 24, a first hydraulic tilt cylinder 26*a*, and a second tilt cylinder 26*b*, as indicated in FIG. 3 by side-to-side tilt arrows 44.

The tilt assembly 40 includes a weldment comprising a stationary weldment including a torsion bar 22 and an ear plate 24 being welded to the skid frame 20.

The torsion bar 22 and ear plate 24 work in conjunction with a pair of tilt cylinders 26*a*, 26*b* rotatingly affixed to end portions of said ear plate 24 via respective clevis 26*c* portions. The torsion bar 22 and ear plate 24 form a singular weldment with the torsion bar 22 being welded perpendicularly at an intermediate portion of the ear plate 24. The end portions of said torsion bar 22 are in turn stationarily welded to opposing inner side surfaces of the skid frame 20, particularly disposed directly underneath a center of gravity of the scissor lift assembly 46 to ensure balanced tilting thereof. The vertical tilt cylinders 26*a*, 26*b* extend downwardly from respective outer end portions of the ear plate 24 and are connected to a lower plate portion 43 of the tilt assembly 40 via additional clevis' 26*c*, thereby acting to tilt said lower plate portion 43 and affixed scissor lift assembly 46. The tilt assembly 40 further comprises an upper plate 42 welded across an upper surface which in turn provides rigid attachment to the scissor lift assembly 46 and man platform 50 portions. Although the tilt assembly 40 is illustrated here utilizing a stationary torsion bar 22 and ear plate 24 mechanism, it is understood that other methods may be utilized to tilt the tilt assembly 40 with equal benefit, and as such should not be interpreted as a limiting factor of the apparatus 10.

The apparatus 10 comprises a hydraulically-powered folding scissor lift assembly 46. The scissor lift assembly 46 comprises a plurality of upwardly extending elements being joined by respective pivot pins 47. The bottommost portion of the scissor lift assembly 46 is in turn affixed to the subjacent horizontal upper plate portion 42 of the tilt assembly 40 via a plurality of mounting brackets 49. The scissor lift assembly 46 further comprises at least one (1) lift cylinder 48*a* and a hydraulic reservoir/pump unit 48*b*. The lift cylinder 48*a* is shown here mounted to adjacent pivotingly connected scissor element portion of the scissor lift assembly 46; however, an actual position of at lease one (1) lift cylinder 48*a* may be located at various positions to apply a spreading force to extend the scissor lift assembly 46, and as such should not be interpreted as a limiting factor of the apparatus 10. The hydraulic reservoir/pump unit 48*b* is preferably mounted to the upper plate 42 which supplies hydraulic pressure to said lift cylinder 48*a* to enable vertical extension of said scissor lift assembly 46. The hydraulic reservoir/pump unit 48*b* is envisioned to comprise a commercially-available self-contained unit including conventional and expected components such as, but not limited to: a fluid reservoir, a pump, an electrical solenoid valve, and corresponding electrical and hydraulic connections. Said hydraulic lift cylinder 48*a* and hydraulic reservoir/pump unit 48*b* are interconnected with a plurality of hydraulic lines 48*c* (see FIG. 5).

A top portion of the folding scissor lift assembly 46 provides an attachment means to a floor portion of the metal man platform 50 via additional pivoting mounting brackets 49. The man platform 50 comprises expected features including a platform floor 58, a hand rail 57 located along a perimeter of the platform floor 58, a gate 51 located along a side portion of the hand rail 57, and a lift control panel 52 preferably mounted to the hand rail using appropriate bracketry. The platform 50 may also have a ladder 56 mounted thereon. The lift control panel 52 provides a means for an operator to control vertical motions of the scissor lift assembly 46 while occupying the man platform 50 via manipulation of an integrated lift switch 53 (see FIG. 5).

The existing skid steer loader 100 is envisioned to be equipped with standard front-to-rear tilting capability to tilt the apparatus 10 in a front-to-rear direction as indicated by a front-to-rear tilt arrow 30. The hydraulic lift cylinder 48*a* portion of the tilt assembly 40 are in hydraulic communication with, and controlled by existing hydraulic system portions of the skid steer loader 100, thereby allowing operation of the tilt assembly 40 in a similar manner as various mountable skid steer loader implements (see FIG. 6). The side-to-side 44 and front-to-rear 30 tilting capabilities of the apparatus 10 work in conjunction with four (4) independent height-adjustable safety feet portions 28 of the skid frame 20 to allow secure placement of the apparatus 10 upon an uneven ground surface 110. Each safety foot 28 comprises a pair of telescoping structural tubing sections having a pointed bottom end portion. Each safety foot 28 extends downwardly in a telescoping manner, being locked at a desired length using a plurality of through-hole-type fasteners 29*a* such as release pins, and corresponding fastener apertures 29*b*.

The apparatus 10 is envisioned to meet all applicable local, state, and federal safety regulations for personnel lifting equipment. The features of the apparatus 10 allow the man platform 50 to either be raised slightly above a ground surface 110 using the lifting capabilities of the skid steer loader 100, or may be raised up to approximately twenty feet (20 ft.) by utilizing the functions of the scissor lift assembly portion 46 of the apparatus 10.

The apparatus 10 provides reduced equipment costs by eliminating a number of expensive hydraulic and control components such transportation features such as wheels and steering equipment, and the like, as compared to the scissor lift unit 46. By interfacing and utilizing said existing systems which reside upon the skid steer loader 100, the apparatus 10 is more feasible, cost effective, and easy to store.

Figure 5:
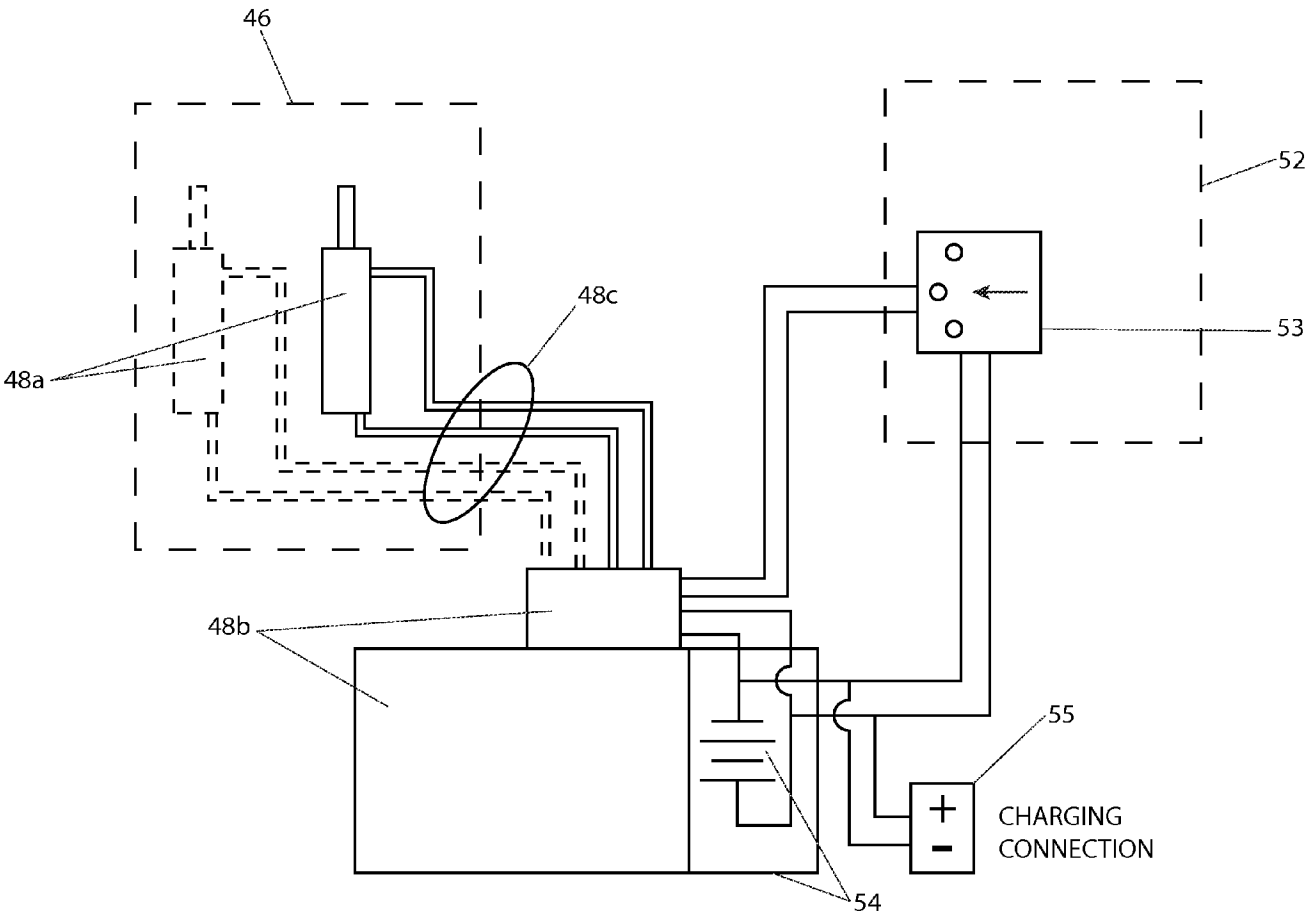
FIG. 5 is an electrical/hydraulic block diagram of the scissor lift assembly portion 46 of the skid-mounted scissor lift platform 10, according to a preferred embodiment of the present invention; and, FIG. 6 is an electrical/hydraulic block diagram of the tilt assembly portion 40 of the skid-mounted scissor lift platform 10, according to a preferred embodiment of the present invention.

Referring now to FIG. 5, an electrical/hydraulic block diagram of the scissor lift assembly portion 46 of the apparatus 10, according to a preferred embodiment of the present invention, is disclosed. The scissor lift assembly 46 comprises a lift control panel 52 further comprising a lift switch 53. The lift switch 53 preferably comprises a three-position, center-return toggle-type switch, or equivalent component, which allows an operator to raise and lower the scissor lift assembly 46 while occupying the man platform 50. The lift switch 53 is in electrical communication with the aforementioned hydraulic reservoir/pump unit 48*b*. Upon receiving an electrical signal from the lift switch 53, the hydraulic reservoir/pump unit 48*b* supplies hydraulic pressure to the lift cylinder portion 48*a* of the scissor lift assembly 46 to raise or lower the man platform 50. Electrical power is supplied to the lift switch 53 and hydraulic reservoir/pump unit 48*b* portions via a battery/battery box 54 mounted to the upper plate 42. It is envisioned that the battery/battery box 54 includes a battery charging connector portion 55 for periodic recharging of the battery.

Figure 6:
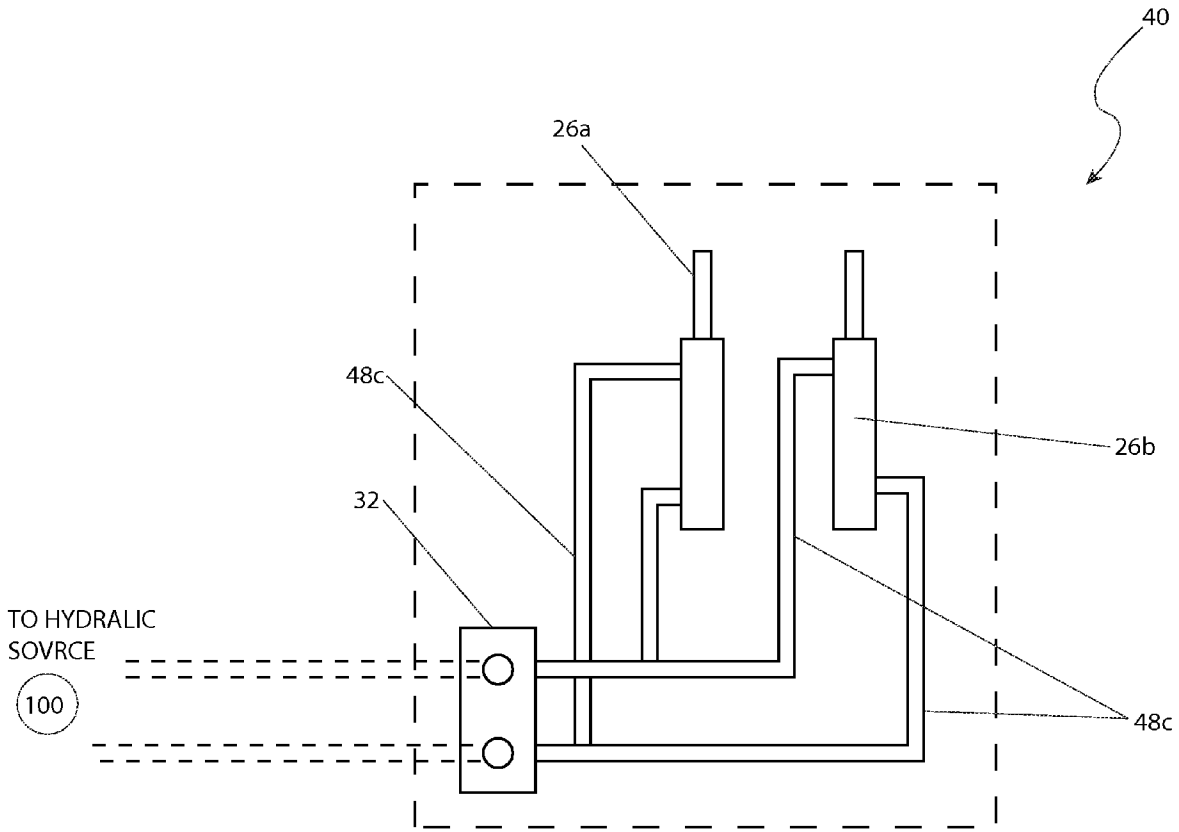

Referring now to FIG. 6, an electrical/hydraulic block diagram of the tilt assembly portion 40 of the apparatus 10, according to a preferred embodiment of the present invention, is disclosed. The hydraulic portions of the tilt assembly 40 are in hydraulic communication with, and controlled by an existing hydraulic system of the skid steer loader 100 via connection of loader hydraulic hose portions 27 of the skid steer loader 100 and a hydraulic connector 32 located upon an outer surface of the skid frame 20. The apparatus 10 in turn route hydraulic fluid from the hydraulic connector 32 to the tilt cylinders 26*a*, 26*b* via hydraulic lines 48*c* allowing operation of the tilt assembly 40 in a similar manner as various other skid steer loader implements.

It is envisioned that other styles and configurations of the present invention can be easily incorporated into the teachings of the present invention, and only one particular configuration shall be shown and described for purposes of clarity and disclosure and not by way of limitation of scope.

Figure 2:
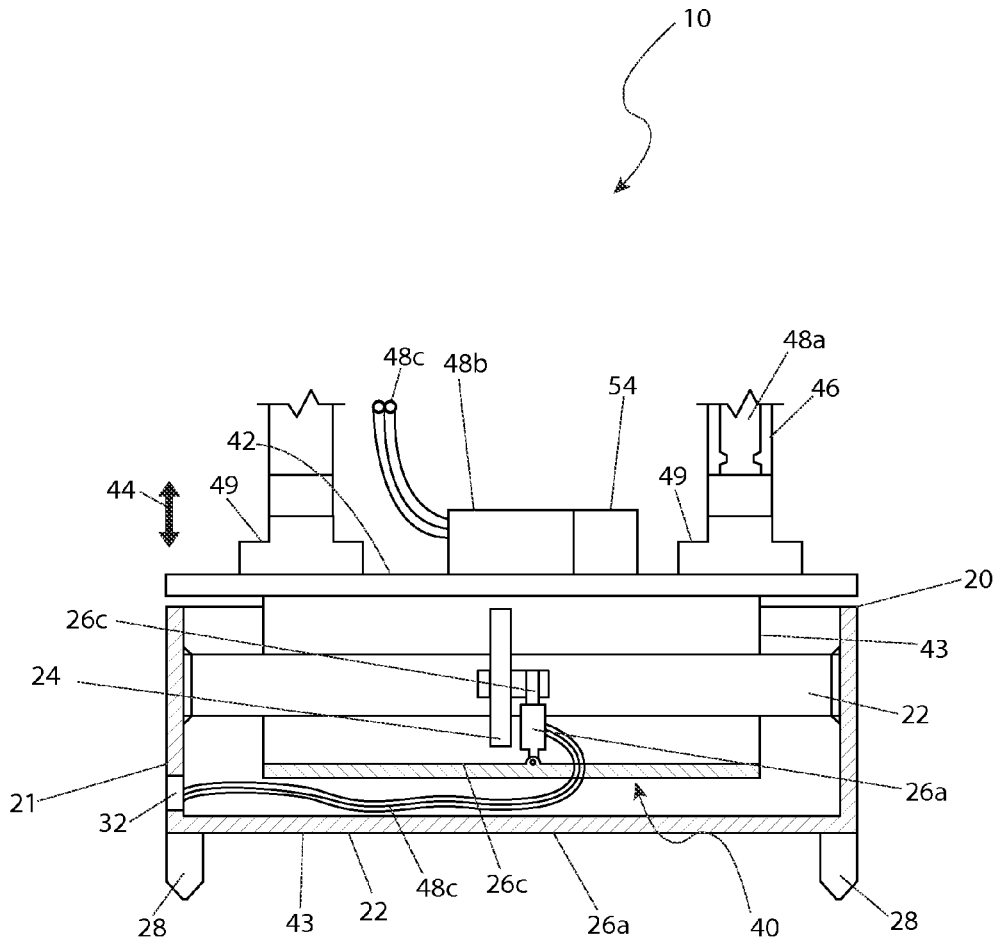
FIG. 2 is a side cut-out view of a skid-mounted scissor lift platform 10, according to a preferred embodiment of the present invention.

The preferred embodiment of the present invention is envisioned to be utilized by a trained equipment operator while requiring minimal additional training. After initial purchase or acquisition of the apparatus 10, it would be utilized as indicated in FIGS. 1 and 2.

The method of utilizing the apparatus 10 may be achieved by performing the following steps: procuring the apparatus 10; attaching the implement attachment means 105 of the existing skid steer loader 100 to the matching skid steer plate portion 21 of the skid frame 20; connecting loader hydraulic hose portions 27 of the skid steer loader 100 to the hydraulic connector portion 32 of the skid frame 20; transporting the apparatus 10 to a job site using the skid steer loader 100; lowering the skid frame 20 until the safety feet 28 are slightly above a ground surface 110; using the front-to-rear tilt capabilities of the skid steer loader 100 to tilt the apparatus 10 until level in a front-to-rear direction; lowering each safety foot 28 until making contact with the ground surface 110; locking all safety feet 28 in position by inserting through-bolt fasteners 29*a* through corresponding fastener apertures 29*b*; lowering the apparatus 10 onto the ground surface 110, using lift controls of the skid steer loader 100 until the weight of the apparatus 10 rests securely upon the ground surface 110 via the safety feet 28; using control portions of the skid steer loader 100 to adjust the tilt cylinders 26*a*, 26*b* until the skid frame 20 and man platform 50 are level in a side-to-side direction; occupying the man platform 50; utilizing the lift switch portion 53 of the control panel 52 to raise the man platform 50 to a desired height, as needed during the execution of a construction project or similar task; and, benefiting from increased safety and equipment simplicity to lift personnel and equipment afforded a user of the present invention 10.

The use of the apparatus 10 provides the complete functionality of a scissor lift unit 46 with reduced equipment costs, reduced floor space usage, and increased simplicity.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A scissor lift platform assembly, comprising:

a frame, configured to be attached to a skid steer assembly and comprising:

a box-like frame portion, having a front panel, a rear panel, a side panel, and a skid steer plate disposed vertically along a side opposite said side panel;

height-adjustable safety feet located at bottom corners thereof;

wherein said skid steer plate is configured for attachment to an attachment means on said skid steer assembly;

a tilt assembly attached to said frame, comprising:

a box-shaped structure having a pair of side portions, a lower plate portion, and an upper plate portion;

a torsion bar, longitudinally spanning a distance between and attached to opposing inner surfaces of said structure;

an ear plate affixed to an intermediate location along said torsion bar and having a first and a second end extending outwardly from opposing sides thereof;

a first tilt cylinder having a first upper end rotatingly affixed to said first end of said ear plate and a first lower end affixed to said lower plate portion; and, a second tilt cylinder having a second upper end rotatingly affixed to said second end of said ear plate and a second lower end affixed to said lower plate portion;

wherein said first and second tilt cylinders are each adapted to be driven by an on-board hydraulic mechanism by said skid steer assembly;

a scissor lift assembly attached to said tilt assembly and driven by a scissor lift hydraulic mechanism;

a platform attached to an upper portion of said scissor lift assembly;

wherein said scissor lift assembly is selectively raised and lowered by said scissor lift hydraulic mechanism;

wherein said scissor lift assembly is selectively motioned side-to-side relative to said skid steer assembly via said tilt assembly; and, wherein said scissor lift assembly is selectively motioned front-to-rear concurrent with said skid steer assembly.

2. The assembly of claim 1, wherein each of said feet further comprises:

a first tubular section;

a second tubular section slidingly engaging said first tubular section; and, a securing means for securing said second tubular section at a desired height relative to said first tubular section.

3. The assembly of claim 1, wherein said first and second tilt cylinders are each attached to said ear plate and to said lower plate portion with a respective clevis fastener.

4. The assembly of claim 1, wherein said torsion bar is affixed to said structure directly underneath a center of gravity of the scissor lift assembly and platform.

5. The assembly of claim 1, wherein said scissor lift assembly further comprises:

at least one pair of lower brackets affixed to an upper surface of said upper plate portion of said tilt assembly;

a first plurality of upwardly extending scissor elements joined by respective pivot pins;

a second plurality of upwardly extending scissor elements joined by respective pivot pins; and, at least one pair of upper brackets, each affixed to an uppermost pair of each of said first and second plurality of scissor elements;

wherein a bottommost pair of each of said first and second plurality of scissor elements is pivotally attached to one of said at least one pair of lower brackets.

6. The assembly of claim 5, wherein said scissor lift assembly can be raised to a height of approximately twenty feet.

7. The assembly of claim 5, further comprising four lower brackets and four upper brackets.

8. The assembly of claim 5, wherein said scissor lift hydraulic mechanism further comprises at least one lift cylinder mounted adjacent to and mechanically driving said bottommost one of either said first or second plurality of scissor elements, said at least one lift cylinder driven by a hydraulic unit mounted to said tilt assembly;

wherein said at least one lift cylinder enables vertical extension of said scissor lift assembly; and, wherein said hydraulic unit is in electrical communication with a battery within a battery housing mounted to said tilt assembly.

9. The assembly of claim 8, wherein said battery further comprises a charging port adapted to be in electrical communication with a power source for recharging said battery.

10. The assembly of claim 8, wherein said hydraulic unit further comprises a fluid reservoir, a pump, an electrical solenoid valve, and corresponding electrical and hydraulic connections.

11. The assembly of claim 5, wherein said platform further comprises:

a floor portion attached to said at least one pair of upper brackets;

a hand rail extending upward from a perimeter of said floor portion;

a gate located along a side portion of said hand rail; and, a lift control panel mounted to said hand rail, further having a lift switch;

wherein said lift switch is in electrical communication with said scissor lift hydraulic mechanism.

12. The assembly of claim 11, further comprising a ladder having an upper end affixed to said platform.

13. The assembly of claim 11, wherein said lift control switch further comprises a three-position, center-return toggle switch.

* * * * *